United States Patent [19]

Eadie

[11] 4,296,527

[45] Oct. 27, 1981

[54] TEXTILE COMBING ROLLER

[75] Inventor: Brian K. M. Eadie, Johnstone, Scotland

[73] Assignee: Eadie Bros. & Co. Limited, Paisley, Scotland

[21] Appl. No.: 31,472

[22] Filed: Apr. 19, 1979

[51] Int. Cl.[3] ..... D01G 19/10

[52] U.S. Cl. ..... 19/112; 19/97; 29/121.1; 57/58.91

[58] Field of Search ..... 19/83, 97, 112; 29/120, 29/121.1, 121.5, 121.6, 123; 57/58.91, 58.95

[56] References Cited

U.S. PATENT DOCUMENTS

| | | | |
|---|---|---|---|
| 1,345,207 | 6/1920 | McLean | 29/121.6 |
| 1,394,684 | 10/1921 | Matsuo | 29/121.1 |
| 3,968,542 | 7/1976 | Hollingsworth | 19/97 |
| 4,044,427 | 8/1977 | Ankrom | 19/97 |
| 4,163,304 | 8/1979 | Laflaquiere et al. | 19/97 |
| 4,196,496 | 4/1980 | Stauffer | 19/97 |
| 4,208,767 | 6/1980 | Schmolke | 19/97 |

FOREIGN PATENT DOCUMENTS

| | | |
|---|---|---|
| 2528485 | 12/1976 | Fed. Rep. of Germany . |
| 48-29130 | 10/1973 | Japan . |
| 1234327 | 6/1971 | United Kingdom . |
| 1387627 | 3/1975 | United Kingdom . |

*Primary Examiner*—Louis Rimrodt
*Attorney, Agent, or Firm*—Norris & Bateman

[57] ABSTRACT

The invention relates to opening rollers for open-end spinning wherein the opening roller has a support part for attachment to the driving spindle and an adapter having the fiber engaging teeth of the roller. According to one aspect of the invention, the support part and adapter have a releasable connection which both establishes driving attachment of the adapter to the support part and secures the adapter on the support part without the intervention of a third element. The invention also includes an arrangement in which a screw screwed axially into the support part has a head received in a recess formed partly in the support part and partly in the adapter whereby the screw both establishes a driving connection between the two parts and secures the adapter to the support part.

9 Claims, 5 Drawing Figures

TEXTILE COMBING ROLLER

Figure 1:
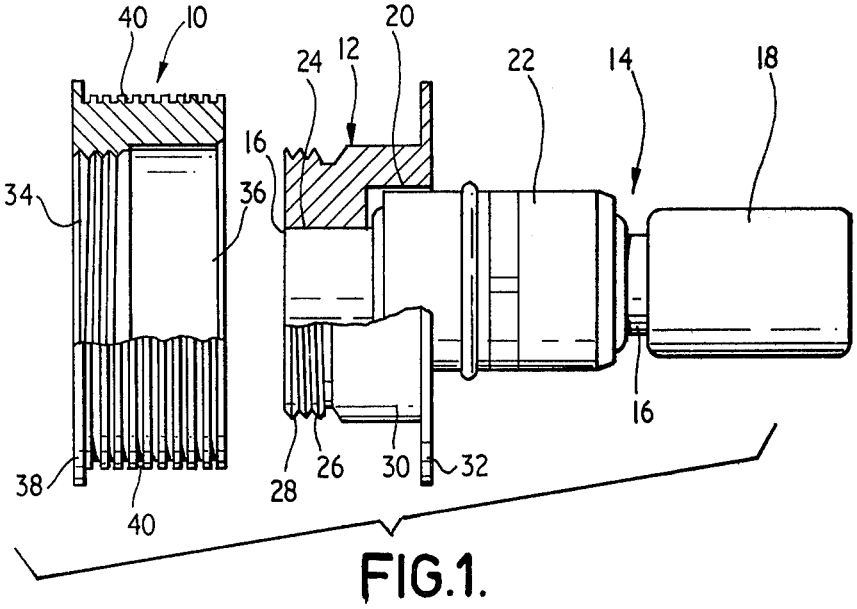

This invention relates to opening rollers for open-end spinning apparatus, that is to say, rollers which have a cylindrical surface from which teeth project for engagement with the sliver of fibrous material, which is fed through the apparatus.

A commonly used opening roller has its teeth formed by individual pins located in radial holes formed in the body of the roller, but such a roller is relatively expensive to construct because of the method of manufacturing and locating the pins, and because of the necessity to balance the roller due to the high angular velocity of the roller in use. It is known to employ metallic wire type card-clothing wrapped around the roller (see for example United Kingdom patent specification No. 1,387,627) to provide the toothed surface and although this method of construction is cheaper than constructing a pinned roller, it is still necessary to balance the roller.

The teeth of an opening roller are sometimes subject to quite severe wear, and when the teeth are too badly worn to function effectively, the entire roller has to be replaced.

The process of removing the roller from the machine spindle (on which it has to be a press fit) replacing it with a new roller and rebalancing the refurbished roller is time consuming and expensive. Moreover, it is very often carried out without correct balancing which has a deleterious effect on the opening roller assembly, or if correct balancing is required, the roller usually has to be returned to the manufacturer.

In the published German patent specification OLS 2528485 an opening roller is described in which card-clothing is wrapped on to a thin metal sleeve, and this sleeve is supported partly on a narrow shoulder formed on the roller body, and mainly on a clamping ring, which is secured to the body by a series of screws. The card-clothing sleeve is held in place by a radially slit spring ring which is distended outwardly into frictional engagement with the inside of the card-clothed sleeve. This enables the card-clothed sleeve to be replaced without replacing the entire roller, but the roller construction is itself relatively complex, and since the roller will almost certainly require rebalancing every time a fresh card-clothed sleeve is fitted.

According to one aspect of this invention, an opening roller for an open-end spinning apparatus comprises a support part adapted to be drivingly attached to the spindle of the apparatus, and a sleeve-like adapter constructed for releasable driving connection to the support part, and having teeth secured to a cylindrical external surface thereof, providing the fibre engaging teeth of the roller, the releasable connection being such that it both establishes driving attachment of said adapter to said support part and secures said adapter on said support part without the intervention of a third element.

This construction of the opening roller is relatively inexpensive, because of its simplicity, and it is possible to remove the adapter when the teeth are worn, and to replace it by another toothed adapter without having to dismantle, reassemble and rebalance the roller assembly. Thus it becomes possible to maintain a stock of toothed adapters at the mill, and to replace an adapter on which the teeth have become worn, from this stock, thus ensuring a minimum loss of production on the spinning machine.

In one construction, the driving connection is provided by inter-engageable screw-threaded portions of the support part and the adapter, the direction of the screw-thread being such that any tendency to relative rotation between the support part and the adapter due to inertia of the adapter, on starting up of the spindle, tends to tighten the adapter on to the support part.

In another construction, tapered location surfaces are provided on the support part and the adapter, so that a taper lock driving connection is established between these parts, merely by axially applied pressure when the adapter is fitted on to the support part.

According to a preferred feature of the invention, the mating location surfaces are cylindrical, and one or both of these surfaces may be relieved along part of its length.

According to another aspect of the invention, an opening roller for an open-end spinning apparatus comprises a support part adapted to be drivingly attached to the spindle of the apparatus a cylindrical sleeve-like adapter constructed for releasable connection to the support part, and having teeth secured to a cylindrical external surface thereof, providing the fibre engaging teeth of the roller, and a screw screwed axially into said support part and having its head received in a recess formed partly in said support part and partly in said adapter whereby said screw both establishes a driving connection between said support part and said adapter and secures said adapter on said support part.

Metallic wire type card-clothing may be applied to the external surface of the adapter to provide the teeth but it is to be understood that the invention also includes the use of flexible foundation type card-clothing or pins or indeed any other method whereby teeth are provided on the external surfaces.

Figure 2:
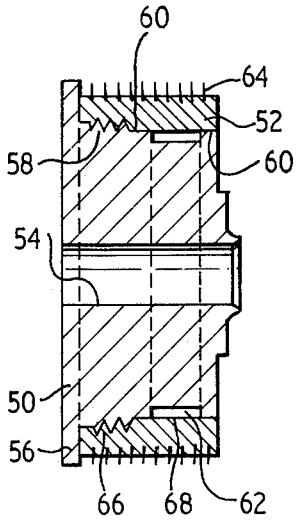
Figure 3:
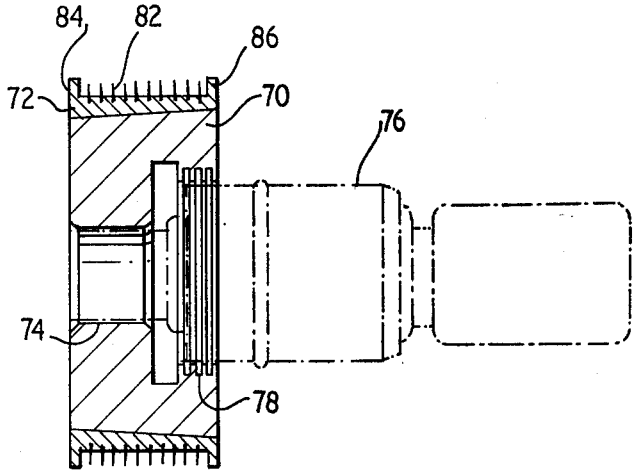
Figure 4:
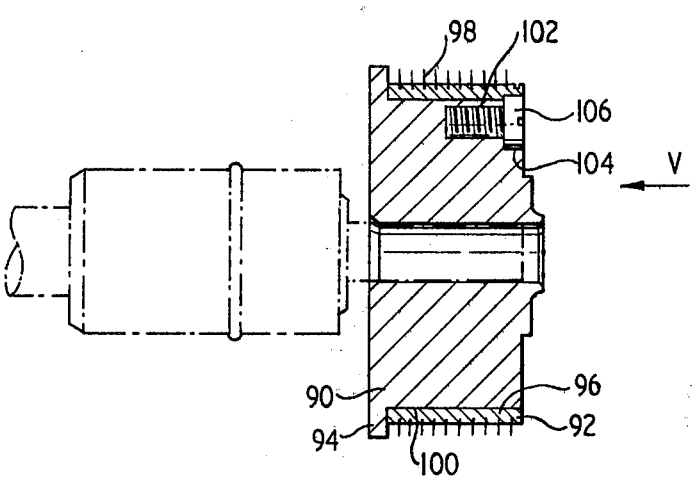
Figure 5:
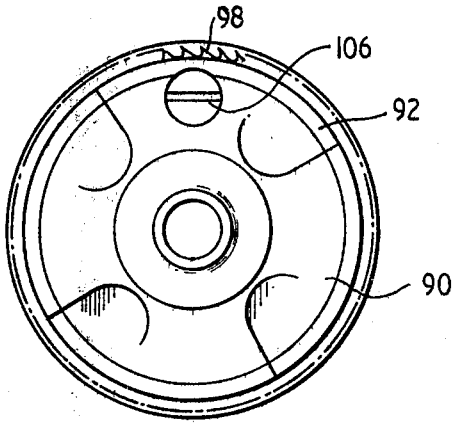

Four different types of opening roller for use on open-end spinning apparatus, each constructed in accordance with the invention, will now be described by way of examples only, with reference to the accompanying drawings, in which:

FIG. 1 is a longitudinal cross-section through an opening roller mounted on a spindle, but with an adapter disconnected, FIG. 2 is a section through an alternative construction of opening roller, FIG. 3 is a section through a third form of opening roller, the spindle being illustrated in chain-dotted lines, FIG. 4 is a section through a fourth type of opening roller, with the spindle shown chain-dotted, and FIG. 5 is an end view looking in the direction of the arrow V in FIG. 4.

The roller illustrated in FIG. 1 of the drawings, essentially comprises an adapter 10, a support part 12, and a spindle assembly 14. The adapter 10, a support part 12, may be made in metal such as aluminium, aluminium alloy or steel or brass, or even plastics.

The spindle assembly 14 is itself of known construction, and comprises a steel shaft 16 on to one end of which is pressed a belt-drive pulley 18, the shaft being journalled in a bearing housing 22, which contains a pair of ball bearings (not visible in the drawing). The bearing housing 22 is clamped in a bore of a casting (not shown) which forms a static part of the spinning machine.

One end portion of the shaft 16 is press fitted into a bore 24 of the support part 12, and the corresponding end of the bearing housing 22 is received in an enlarged bore 20 of the support part, there being a clearance between the housing 22 and the bore 20. Because the support part is a press fit on the shaft 16, these two parts normally remain connected, and can be considered as a unitary support part of the roller. The support part could in fact be formed integrally with the shaft 16, but that would be more expensive to produce than the shaft and support part arrangement illustrated.

The support part has a boss 26 formed with an external screw-thread 28 along part of its length, and a slightly larger diameter plain cylindrical location portion 30. At the non-threaded end, the support part has a flange 32.

The adapter 10 is generally in the form of a ring, the bore of which has an internal screw-threaded portion 34 to receive the threaded portion 28 of the support part, and a plain cylindrical location portion 36 to receive the cylindrical portion 30 of the support part. At its threaded end, the adapter has a flange 38 of the same outside diameter as the flange 32 on the support part.

It is possible to screw the adapter 10 on to the support part 12, and when it is tightened on to the support part, the adapter is firmly located in two planes at right angles at each other and against the inside face of the flange 32 of the support part, thereby ensuring that the periphery of the adapter 10 is concentric with the longitudinal axis of the shaft 16. A rectangular cross-section helical groove 40 is formed in the periphery of the adapter, so that when the latter is assembled on the support part, the groove 40 extends between the two flanges 32 and 38. Metallic wire type card-clothing (not shown in FIG. 1) is wound into the groove 40, so that its teeth project radially from the adapter, within the length bounded by the flanges 32 and 38. The groove 40 serves to locate the card-clothing wire, so that there are the reuired comparatively wide spaces between adjacent convolutions of the wire. In a carding machine, the card-clothing is normally wound with adjacent convolutions abutting each other, but if this is attempted on an opening roller for an open-end spinning device, it is found that the spaces between adjacent convolutions of the wire are not wide enough. For this reason, some spacing expedient such as the helical groove 40 has to be adopted. When the card-clothing has been fitted, the roller presents the card-clothed cylindrical surface required by an opening roller in an open-end spinning device.

If it is required to service the roller, for example, to replace the card-clothing on the adapter, it is only necessary to unscrew the adapter 10 from the support part 12, and it is not necessary to remove the shaft 16 from its bearings. In fact, another replacement adapter could be screwed onto the support part, and if a stock of such replacement adapters is available already card clothed, it is only necessary to stop the spinning machine long enough to unscrew the adapter, and to replace it with a fresh adapter.

Balance of the adapter is largely ensured by the extended location surfaces 30 and 36. Because these location surfaces are of considerable length relatively to the total length of the adapter 10, it is possible to ensure that the adapter seats concentrically on the support part 12, with a much greater accuracy, than could be ensured merely by a screw-threaded connection between the support part and the adapter.

The opening roller which is illustrated in FIG. 2 has a support part 50, and an adapter 52, which are both made in aluminium or aluminium alloy, but which are of somewhat different design to the corresponding parts shown in FIG. 1. The support part 50 does not have an enlarged bore to receive part of the bearing housing, but instead has a through bore 54 whereby it is adapted to be press-fitted on to a somewhat longer shaft extension than that illustrated in FIG. 1. However, the arrangement is still such that when the support part 50 is pressed on to the spindle extension, it is drivingly connected thereto, and can be regarded as virtually integral with the spindle.

The support part 50 has a flange 56 at its inner end (i.e. the end nearest to the bearing housing for the spindle) and it is formed with an externally screw-threaded portion 58 adjacent to the flange 56, and a plain cylindrical location surface 60 projecting beyond the screw-threaded portion 58. In other words, this is the reverse of the arrangement shown in FIG. 1, where the location surface 30 is adjacent to the flange 32, and the externally screw-theaded portion 28 is remote from that flange. In the construction illustrated in FIG. 2, a considerable part of the location surface 60 is relieved by an annular recess 62 formed in the support part, but there are "lands" on opposite sides of the recess 62, so that the effective overall length of the location surface 60 extends across these lands, and across the recess 62.

The sleeve 52 is generally in the form of a ring, and metallic wire type card-clothing 64 is secured to the exterior of the ring, for example by winding into a groove similar to the groove 40 illustrated in FIG. 1, and then securing the ends of the wire either by soldering, or by mechanical deformation. In FIG. 2, the actual helical groove has not been illustrated, and the card-clothing 64 is only illustrated diagrammatically.

Internally, the adapter 52 is formed with a short screw-threaded portion 66 for engagement on the screw-threaded portion 58 of the support part, and with a plain cylindrical location surface 68, for mating engagement with the location surface 60 on the support part.

In order to assemble the opening roller, the adapter 52 complete with its card-clothing 64, is simply screwed on to the support part 58, until it abuts against the flange 56. As with the opening roller illustrated in FIG. 1, radial location of the adapter 52 is ensured within fine limits, by the location surfaces 60 and 68, which extend over a considerable portion of the length of the adapter 52, and certainly over half the length of the card-clothed portion of that adapter.

It will be appreciated, that the location portion of the support part 50 need not be relieved, and equally, that the relieving could be carried out in the surface 68 of the adapter 52, rather than in the support part. It will also be appreciated, that either of the cylindrical location surfaces 30 and 36 illustrated in FIG. 1 could be similarly relieved.

Both the arrangements illustrated in FIGS. 1 and 2 of the drawings rely upon a screwed connection between the support part and the adapter, for securing the adapter on the support part. It is a significant feature of the construction, that the direction of the screw thread is such that there is no tendency for the adapter 10 or 52 to work loose on the support part during operation of the spinning machine. On starting up of the apparatus, when the spindle is rotated, the inertia of the adapter will tend to cause relative rotation between the support part, and the adapter. However, the screw thread is so arranged, that any such relative rotation would have the effect of tightening the adapter against the flange 32 or 56 as the case may be, on the support part.

Turning now to FIG. 3, there is illustrated an opening roller which again comprises a support part 70 and an adapter 72, both of which are made in aluminium or aluminium alloy, the support part 70 having a bore 74 which is a press fit on the shaft extension of a spindle arrangement 76, and an enlarged bore 78 which receives part of the bearing housing of the spindle assembly 76. In its attachment to the spindle assembly therefore, the support part 70 resembles the support part 12 illustrated in FIG. 1. However, the external surface of the support part 70 simply comprises a plain frusto-conical surface 80, extending the full length of the support part, and there are no end flanges on the support part.

The adapter 72 is formed as a ring, and is fitted with metallic wire type card-clothing 82, in similar manner to the adapters 10 and 52 previously described. In this particular construction end flanges 84 and 86 are provided one at each end of the adapter 72 but this is an optional feature. The bore of the adapter 72 takes the form of a frusto-conical surface corresponding to the surface 80 formed on the exterior of the support part 70, and the arrangement is such, that the adapter 72 can be pressed axially on to the support part 70, where it will be accurately located radially, by the mating surfaces, and providing sufficient axial pressure is applied to the adapter, a taper lock effect will be obtained, so that the adapter becomes drivingly connected to the support part. It will be appreciated, that the cone angle of the tapered surface must be relatively small, in order to obtain the taper lock effect. Axial location of the adapter relatively to the support part may be subject to some slight variation, but this is no where near so critical as the radial location.

When it is required to remove the adapter 72, in order to replace the card-clothing on the roller, a special tool (not shown) must be used, which will grip the flange 84, and press against the outer end surface of the support part 70, in order to ease the adapter 72 off the support part.

It will be appreciated that the construction shown in FIG. 3 provides an extremely simple method of connecting the support part and the adapter, without the intervention of third elements such as screws, and that one is able to obtain the necessary driving connection between the two parts of the roller through the taper lock effect.

FIGS. 4 and 5 illustrate another form of the invention, in which the opening roller has a support part 90, and an adapter 92, both of which are formed in aluminium or aluminium alloy. The support part 90 is somewhat similar to that illustrated in FIG. 2, in that it is intended to fit on a plain cylindrical shaft of the spindle assembly, and it has a flange 94 at its inner end. Outwardly of this flange, the support part has a plain cylindrical location surface 96, which extends to the outer end of the support part.

The adapter 92 takes the form of a ring, which in this instance does not have an end flange, but which is fitted with metallic wire type card-clothing 98 in similar mannner to the adapter illustrated in FIG. 1. The adapter 92 has a plain cylindrical bore 100 which provides a radial location on the cylindrical location surface 96 of the support part 90, and in this instance, the location extends throughout the length of the adapter 92. It will of course be understood, that either of the surfaces 96 and 100 could be relieved in similar manner to the arrangement shown in FIG. 2. Clearly, the adapter will be accurately located on the support part, but provision has to be made to ensure that it will not slide off the support part, and for transmitting drive from the support part to the adapter. For this purpose, a screw-threaded hole 102 is formed in the support part, from the outer end, closely adajcent to the location periphery 96 of the support part, and a circular recess 104 is formed largely in the support part, but a small portion of the recess 104 is formed in the adapter 92. A screw 106 is screwed into the hole 102, after the adapter 92 has been placed on the support part, and when this screw is tightened into position, its head seats snugly in the recess 104, part of the head being thus established in the support part, and part in the adapter. The screw then performs two functions. Firstly, it prevents the adapter sliding off the outer end of the support part, and secondly it provides an effective key which transmits rotary motion from the support part to the adapter.

When it is necessary to service the roller, for example by changing the card-clothing, it is only necessary to unfasten the screw 106, and the adapter 92 can then be slid off its location on the support part, and replaced by a fresh adapter.

It is to be understood, that the invention is not limited to any particular manner of securing the card-clothing on the adapter. For instance, instead of locating the rib of the metallic wire type card-clothing in a groove 40, the card-clothing could be preformed into a coil, and then applied to an external cylindrical surface of the adapter. Also, so-called flexible foundation type card-clothing could be secured to the external surface of the adapter, although so far, flexible foundation type card-clothing has not been successfully used with opening rollers for open-end spinning apparatus. Furthermore, instead of using card-clothing, the adapter in any of the constructions, could be drilled, and fitted with pins in known manner.

I claim:

1. An opening roller for an open-end spinning apparatus comprising: a support part adapted for driving attachment to the spindle of the apparatus and a sleeve-like adapter constructed for releasable connection to said support part, said adapter having teeth secured to a cylindrical external surface thereof, providing the fibre engaging teeth of the roller, the releasable connection being such that it both establishes driving attachment of said adapter to said support part and secures said adapter on said support part without the intervention of a third element.

2. An opening roller for an open-end spinning apparatus as claimed in claim 1, wherein said releasable connection comprises interengageable screw-threaded portions of said support part and said adapter, the direction of the screw-threads being such that any tendency to relative rotation between said support part and said adapter due to the inertia of said adapter, on starting up of the spindle, tends to tighten said adapter on to said support part.

3. An opening roller for an open-end spinning apparatus as claimed in claim 1, wherein said releasable connection comprises tapered location surfaces provided respectively on said support part and said adapter, so that a taper lock driving connection is established between these two parts merely by axially applied pressure when said adapter is fitted on to said support part.

4. An opening roller for an open-end spinning apparatus as claimed in claim 1 wherein said support part includes an external surface upon which said first releasable connection means is formed and said adapter includes an interior surface upon which said second releasable connection means is formed.

5. An opening roller for an open-end spinning apparatus comprising: a support part adapted for driving attachment to the spindle of the apparatus; a cylindrical sleeve-like adapter constructed for releasable connection to said support part; teeth secured to the cylindrical external surface of said adapter and projecting radially outwards therefrom, providing fibre-engaging teeth of the roller and at least one screw screwed axially into said support part and having its head received in a recess formed partly in said support part and partly in said adapter whereby said screw both establishes a driving connection between said support path and said adapter and secures said adapter on said support part.

6. An opening roller for an open-end spinning apparatus comprising: a support part adapted for driving attachment to the spindle of the apparatus; a sleeve-like adapter constructed for releasable connection to said support part, said adapter having teeth secured to a cylindrical external surface thereof, providing the fibre engaging tooth of the roller; a first releasable connection means formed integrally on said support part; and a second releasable connector means formed integrally on said adapter and being constructed for mating engagement with said first releasable connection means whereby said support part and adapter are secured together and said adapter is drivingly engaged by said support part solely by said first and second connection means, without need of any additional interengaging means whatsoever.

7. An opeing roller for an open-end spinning apparatus as claimed in claims 6 or 4 wherein said first and second releasable connection means comprise interengageable screw-threaded portions of said support part and said adapter, the direction of the screw-threads being such that any tendency to relative rotation between said support part and said adapter due to the inertia of said adapter, on starting up of the spindle, tends to tighten said adapter on to said support part.

8. An opening roller for an open-end spinning apparatus as claimed in claims 6 or 4, wherein said first and second releasable connection means comprise tapered locations surfaces provided respectively on said support part and said adapter, so that a taper lock driving connection is established between these two parts merely by axially applied pressure when said adapter is fitted on to said support part.

9. An opening roller for an open-end spinning apparatus as claimed in claims 1, 6 or 4, wherein said teeth are formed by metallic wire type card-clothing applied to an external surface of said adapter.

* * * * *

UNITED STATES PATENT AND TRADEMARK OFFICE

CERTIFICATE OF CORRECTION

PATENT NO. : 4,296,527

DATED : October 27, 1981

INVENTOR(S) : Brian K.M. Eadie

It is certified that error appears in the above-identified patent and that said Letters Patent are hereby corrected as shown below:

Column 7, claim 5, line 16, change "path" to --part--.

Signed and Sealed this

*Sixth* Day of *April 1982*

[SEAL]

*Attest:*

GERALD J. MOSSINGHOFF

*Attesting Officer*

*Commissioner of Patents and Trademarks*